United States Patent [19]

Lindstrom

[11] Patent Number: 4,909,332

[45] Date of Patent: Mar. 20, 1990

[54] VIBRATORY PLOW

[75] Inventor: Edgar K. Lindstrom, Wichita, Kans.

[73] Assignee: J. I. Case Company, Racine, Wis.

[21] Appl. No.: 155,398

[22] Filed: Feb. 12, 1988

[51] Int. Cl.[4] ..... A01B 35/00

[52] U.S. Cl. ..... 172/40; 405/182

[58] Field of Search ..... 405/174, 180–183; 172/40, 699

[56] References Cited

U.S. PATENT DOCUMENTS

| | | | |
|---|---|---|---|
| 3,838,740 | 10/1974 | Rogers et al. | 172/40 X |
| 4,103,501 | 8/1978 | La rent | 172/40 X |
| 4,119,157 | 10/1978 | Schuck et al. | 405/182 X |
| 4,164,982 | 8/1979 | Draney | 172/40 |
| 4,240,509 | 12/1980 | Hansen | 172/699 X |
| 4,260,290 | 4/1981 | Flippin | 405/181 |

*Primary Examiner*—David H. Corbin

*Attorney, Agent, or Firm*—Dykema Gossett

[57] ABSTRACT

A vibratory plow assembly for improving the mounting of the plow blade and optimally locating the gage wheels. The assembly includes a plow blade and gage wheel holder that is pivotally mounted to a vibrator frame. The holder includes hollow bearing members for mounting the gage wheels and spaced apart hanger arms for advantageously assisting in the mounting of the plow blade. The plow blade is mounted between the hanger arms such that its upper mounting location is supported between opposed slots in the hanger arms and its lower mounting location is supported between the opposed hollow bearing members.

3 Claims, 3 Drawing Sheets

VIBRATORY PLOW

BACKGROUND OF THE INVENTION

The present invention relates generally to a vibratory plow which is adapted to lay cable, flexible pipe, and the like underground in the cut made by a blade wherein the blade is vibrated to reduce the force required to pull the blade through the ground. More particularly, the present invention relates to a vibratory plow blade and gage wheel holder which provides for improved vibratory plowing.

Vibratory cable plows have been used for several years to lay cable, flexible pipe, and the like underground. The cable or pipe may be either pulled through the cut of the plow blade or a cable chute may be provided on the trailing edge of the plow blade which guides the cable or pipe into the ground from a drum mounted on the tractor or other vehicle. Various types of vibrators have been mounted on the plow blade or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the present invention.

A preferred frame assembly of prior art vibratory plows, as shown in the above-referenced patents, includes two pairs of parallel side links which are resiliently supported by pivotal connections to forward and rearward frame members comprising generally vertical stanchions or columns. The plow blade and vibrator are supported by the rearward frame members. The vibrator generates substantially vertical vibrations in the plow blade when the vehicle is stationary and orbital vibration in the blade as the blade is pulled through the ground.

In vibratory plow constructions of the type just described, the plow blades are heavy and difficult to mount. Typically, the mounting of a vibratory plow blade requires precisely aligning the mounting holes in the long, heavy blade with corresponding holes in a blade holder and then driving pins into place through the mounting holes. This is a very difficult procedure to perform, particularly if there is a need in the field to repair or replace the plow blade. Thus, there has been a need for a vibratory plow construction which simplifies the mounting of the heavy plow blade.

Vibratory plows have also been provided with gage wheels to provide support to the vibrator and plow blade as well as flexing against the substantial vertical shaking. An example of such a construction is shown in U.S. Pat. No. 3,390,533. If, however, the plow blade either follows or precedes the gage wheels, as shown in the just mentioned prior art patent, the blade and cable burial depth will not remain constant. Thus, there has been a need for a vibratory plow construction which locates the plow blade below the area where the gage wheels contact the ground so that any upward or downward movement of the gage wheels because of uneven ground will be directly transmitted to the blade thereby maintaining the plow blade and cable burial depth constant regardless of the contour of the ground surface.

It has now been discovered that a vibratory plow assembly constructed in accordance with the teachings of the present invention both simplifies the mounting of the heavy plow blade to its holder and optimally locates the gage wheels such that their movement is directly transmitted to the blade.

SUMMARY OF THE INVENTION

As described, the vibratory plow assembly of this invention is adapted to lay an elongated element such as a cable or flexible pipe underground in the cut made by the plow blade. The assembly includes a resilient plow frame for mounting the plow on a ground traversing vehicle, such as a tractor, bulldozer, or the like. The preferred frame assembly includes a forward frame member, laterally spaced side frame members, and a rearward frame member which supports the elongated cable plow and the vibrator. The side frame members preferably comprise a pair of generally vertically spaced elongated links which converge in spaced relation toward the forward frame member. The forward and rearward ends of each link are pivotally connected to the forward and rearward frame members.

The vibratory plow blade is mounted to a plow blade and gage wheel holder. The holder is pivotally mounted to the vibrator frame to permit rotational movement by the holder and blade about a vertical axis when the plow assembly is moved to an outboard or lateral position for trenching. The holder also includes hollow axle shafts for mounting gage wheels and spaced apart hanger arms for advantageously assisting in the mounting of the blade.

The plow blade is mounted between the hanger arms such that its upper mounting hole is supported by an upper mounting pin between opposed slots in the hanger arms. Further, the lower mounting hole in the plow blade is supported by a lower mounting pin between the opposed hollow axle shafts. This construction substantially improves the ease in mounting the heavy plow blade and also optimally locates the blade relative to the gage wheels.

When it is desired to mount the plow blade to the holder, the upper blade mounting pin is inserted in the upper plow blade hole and then the blade is positioned between the hanger arms such that the opposed ends of the mounting pin fit within the opposed slots in the hanger arms thereby permitting the blade to hang downwardly. With the plow blade and upper mounting pin in place between the hanger arms, the blade may then be maneuvered so that the lower mounting pin may be inserted through the opposed hollow axle shafts and through the lower blade mounting hole.

The present construction provides for substantially improved mounting of the heavy vibratory plow blade as compared to the prior art where mounting holes in a blade had to be aligned with holes in the blade holder and then mounting pins were driven into place. Moreover, since the gage wheels in the present construction are mounted to the holder on the same centerline or axis as the lower mounting pin for the plow blade, the optimal location for the gage wheels is provided such that any upward or downward movement of the gage wheels because of uneven ground will be directly transmitted to the plow blade.

Other advantages and meritorious features of the present invention will be more fully understood from the following description of the invention, the appended claims and the drawings, a brief description of which follows.

DETAILED DESCRIPTION OF THE INVENTION

Figure 1:
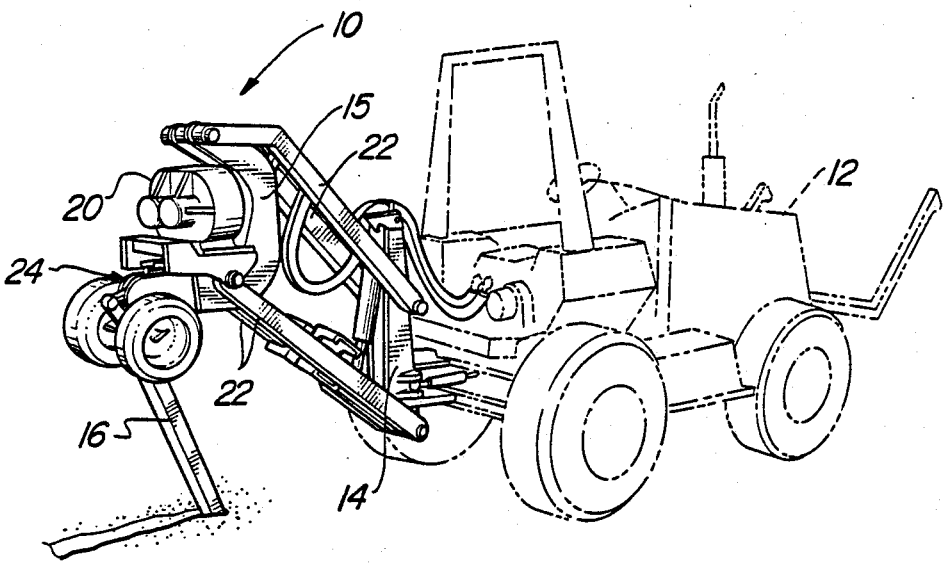
FIG. 1 is a side perspective view of a tractor and vibratory cable laying plow made in accordance with the teachings of the present invention.

Referring to FIG. 1, a vibratory plow assembly 10 made in accordance with the teachings of the present invention is connected to the rear of vehicle 12, which may be a tractor, bulldozer, or the like. Generally, the vibratory plow assembly 10 includes a vertical mast assembly 14 which is attached to the rear of vehicle 12, a vertical shaker frame 15, and a plow blade 16. Blade 16 may include a cable guide (not shown) supported thereon for receiving a cable which is continuously fed into and along the bottom of the ground slot formed by blade 16, as is conventional.

Shaker frame 15 has a power driven oscillating mechanism 20 supported thereon for reciprocating blade 16 vertically between upper and lower limits. Shaker frame 15, oscillating mechanism 20, and blade 16 are suspended from mast assembly 14 by upper and lower pairs of connecting links 22. As is conventional, the oscillating mechanism 20 is adapted to vibrate blade 16 and thereby transmit an arcuate or orbital motion to the blade.

Figure 2:
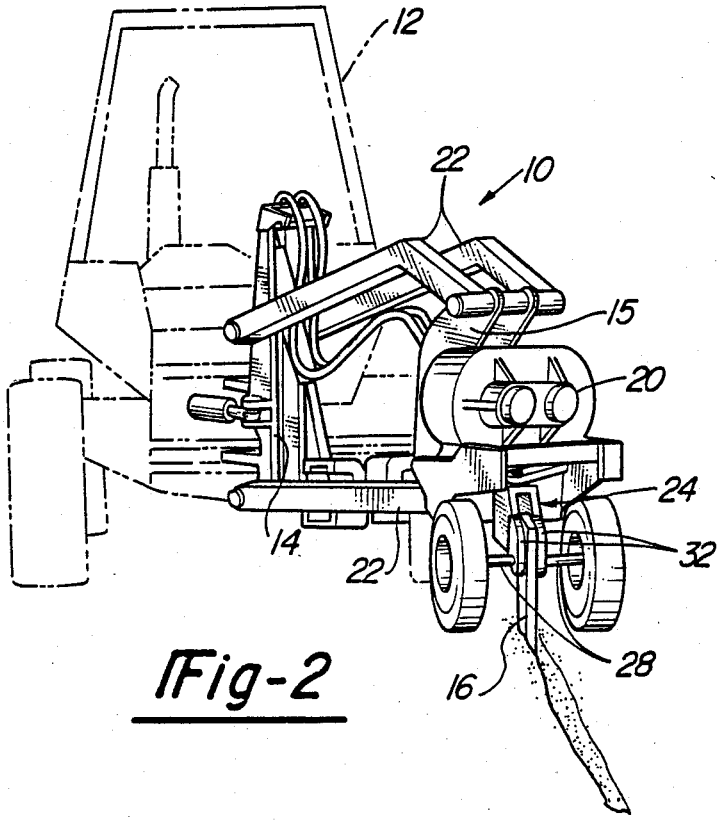
FIG. 2 is a rear view of the vibratory plow assembly shown in FIG. 1.
Figure 3:
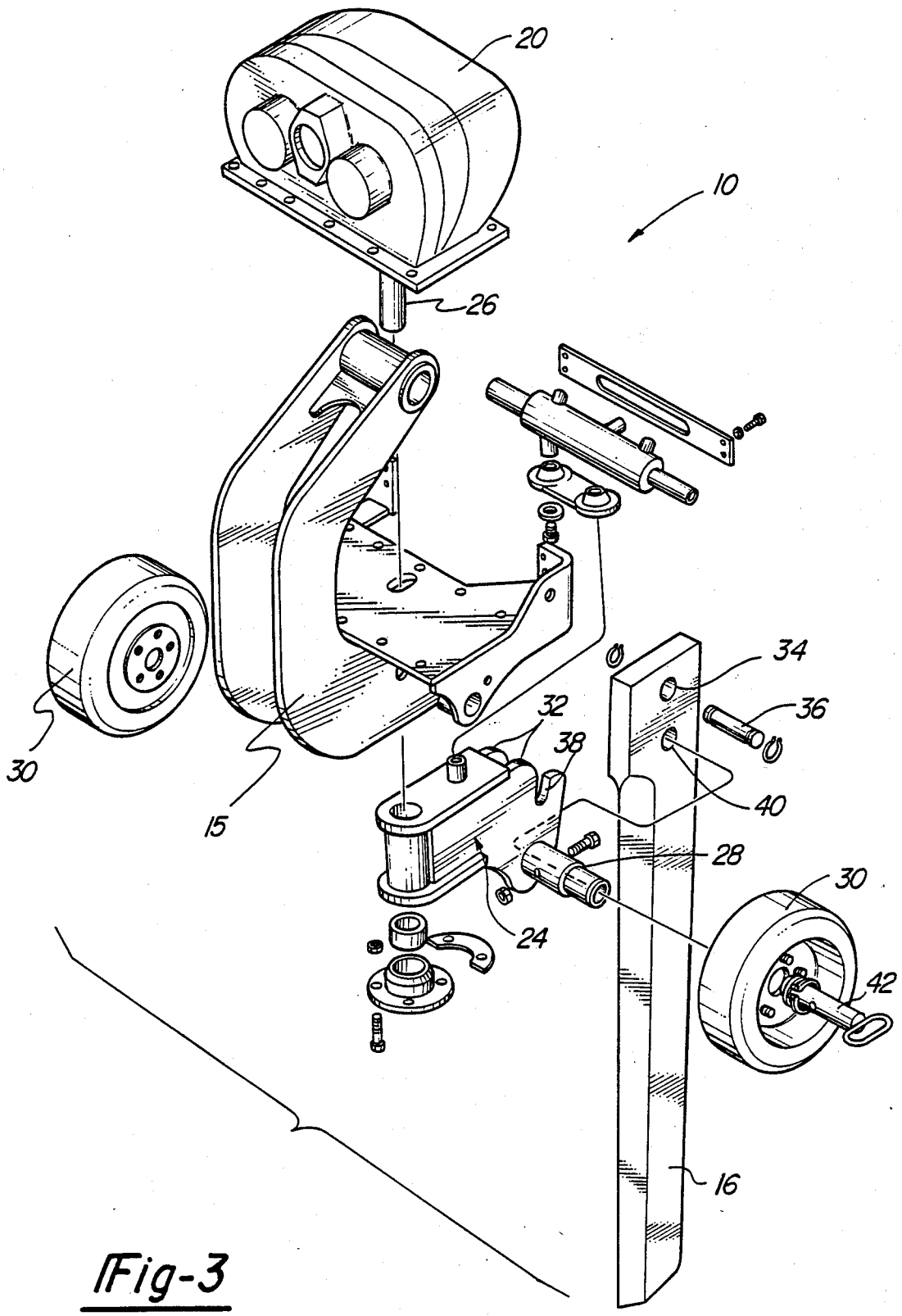
FIG. 3 is an assembly drawing of the plow blade, plow blade holder, and associated structure of the present invention.
Figure 4:
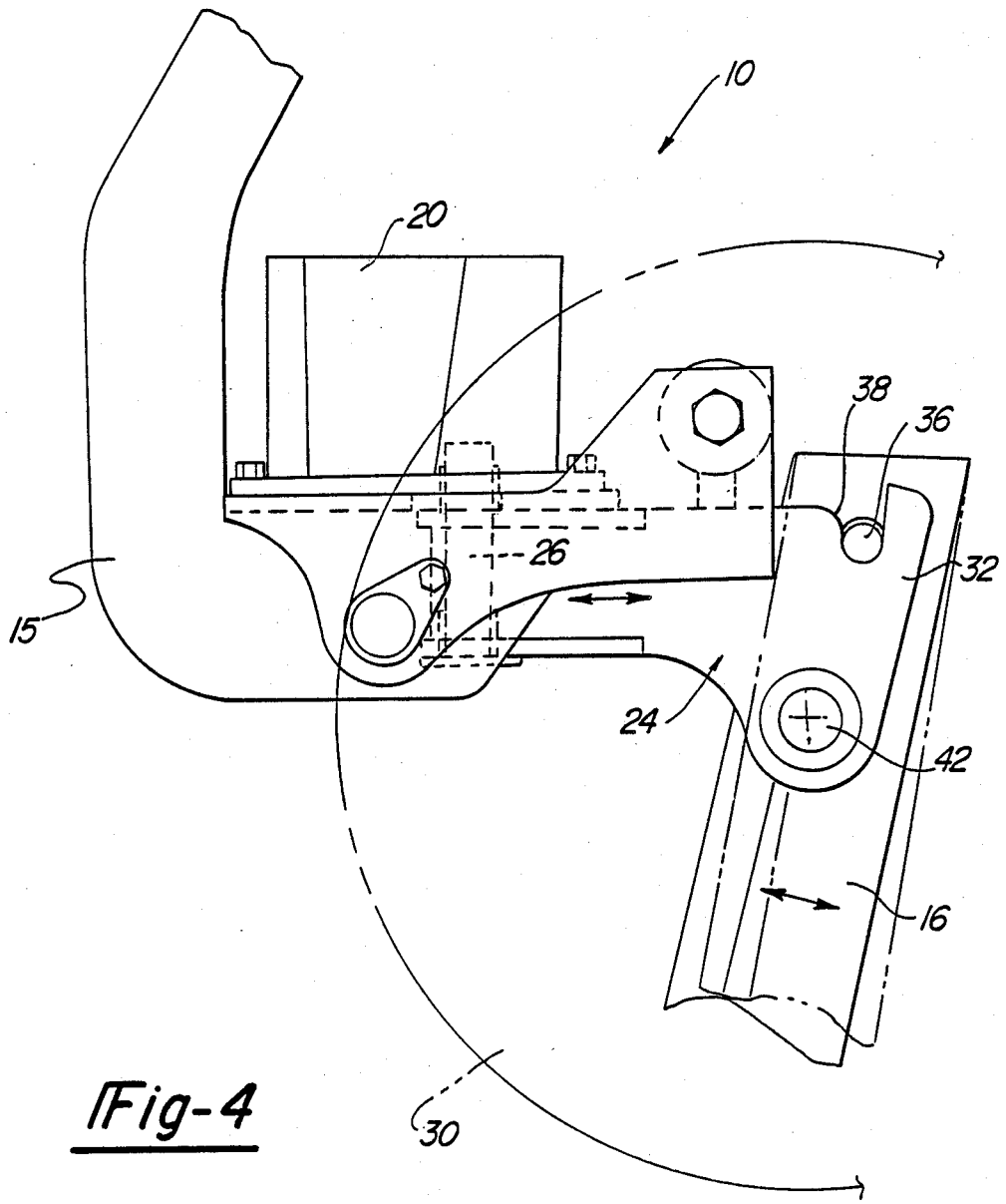
FIG. 4 is a partial side elevational view of the plow blade and plow blade holder.

Referring to FIGS. 2–4, the plow blade assembly 10 and associated structure of the present invention is shown in greater detail. Plow blade 16 is mounted to a plow blade and gage wheel holder 24. Holder 24 is pivotally mounted to shaker frame 15 by pin 26 to permit rotational movement by holder 24 and blade 16 about a vertical axis formed by pin 26 when the plow assembly 10 is moved to an outboard or lateral position for plowing, such as shown in FIG. 2. Holder 24 also includes hollow axle shafts or bearing members 28 for mounting gage wheels 30 and spaced apart hanger arms 32 for advantageously assisting in the mounting of plow blade 16, as will now be described.

Blade 16 is mounted between hanger arms 32 such that its upper mounting hole 34 is supported by pin 36 between opposed slots 38 and its lower mounting hole 40 is supported by pin 42 between opposed hollow axle shafts 28. This construction substantially improves the mounting of the heavy elongated plow blade 16 and optimally locates blade 16 relative to gage wheels 30.

When it is desired to mount blade 16 on holder 24, the upper blade mounting pin 36 is inserted in the upper plow blade hole 34 and then blade 16 is positioned between hanger arms 32 such that the opposed ends of pin 36 fit within the opposed slots 38 thereby permitting blade 16 to hang downwardly. With plow blade 16 and upper mounting pin in place in holder 24, blade 16 can be maneuvered easily so that the lower mounting pin 42 may be inserted through the opposed axle shafts 28 and the lower blade mounting hole 40. The openings through axle shafts 28 are larger than the mounting holes in the hanger arms 32 for ease of assembly.

The above-described construction provides for considerable ease in mounting plow blade 16 as compared to the prior art requirement for precisely aligning holes in a blade with holes in a holder and then driving mounting pins into place. Moreover, since the gage wheels 30 are mounted to holder 24 on the same centerline or axis as lower mounting pin 42, the optimal location for the gage wheels 30 is provided. A substantial length of the plow blade 16 is directly below the area where the gage wheels 30 contact the ground, and therefore, any upward or downward movement of the gage wheels 30 because of uneven ground will be directly transmitted to the plow blade 16. This permits the maintenance of constant blade and cable burial depth regardless of the contour of the ground surface.

It will be understood that the foregoing disclosure is exemplary in nature and that various modifications may be made to this invention without departing from the appended claims.

I claim:

1. In a vibratory plow assembly having a forward frame member, a rearward frame member, and spaced apart side frame members pivotally connecting said forward and rearward frame members to permit vertical movement of said rearward frame member relative to said forward frame member, and a vibrator mounted on said rearward frame member that is adapted to vibrate a plow blade which is mounted to said rearward frame member, wherein the improvement comprising:

a blade holder mounted to said rearward frame member, said blade includes an upper mounting opening and a first pin means extending therethrough, and said blade holder includes opposed hanger arms having slots therein which are open for freely receiving and supporting opposite ends of said first pin means, and said blade positioned between said hanger arms with said first pin means extending through the upper mounting opening such that the opposite ends of the first pin means fit within the open slots to permit hanging support of the blade relative to said blade holder; and wherein the plow blade having a lower mounting opening, a second pin means extending therethrough having a longitudinal axis, means for mounting gage wheels to said blade holder and said mounting means having a longitudinal axis, and said second pin means extending through said mounting means such that the longitudinal axis of said second pin means is substantially coincident with the longitudinal axis of said mounting means.

2. The vibratory plow assembly as defined in claim 1 wherein the mounting means comprises opposed hollow bearing members with said second pin means extending through said hollow bearing members.

3. A vibratory plow assembly having a forward frame member, a rearward frame member, and spaced apart side frame members pivotally connecting said forward and rearward frame members to permit vertical movement of said rearward frame member relative to said forward frame member, and a vibrator mounted on said rearward frame member that is adapted to vibrate a plow blade which is mounted to said rearward frame member, said plow blade including a mounting opening and a first pin means extending therethrough having a longitudinal axis, means for mounting at least one gage wheel to said plow blade and said mounting means having a longitudinal axis, and said first pin means extending through said mounting means such that the longitudinal axis of said first pin means is substantially coincident with the longitudinal axis of said mounting means whereby upward and downward movement of the gage wheel is directly transmitted to the plow blade; and a blade holder mounted to said rearward frame member, said plow blade includes an upper mounting opening, a second pin means extending through said upper mounting opening, said blade holder includes opposed hanger arms having slots therein for supporting opposite ends of said second pin means, and said plow blade positioned between said hanger arms such that the opposite ends of the second pin means fit within the slots.

* * * * *